US005865654A

United States Patent [19]

Shimirak et al.

[11] Patent Number: 5,865,654

[45] Date of Patent: Feb. 2, 1999

[54] COAXIAL CABLE CONNECTOR

[75] Inventors: Gerald Shimirak, Palo Alto; Philip Vail, San Leandro; Nelson Shen, Palo Alto; Nils Wydler, Los Altos; Anthony Vranicar, Santa Clara; Gary Wagner, Menlo Park; Mohamed Higgy, Redwood City, all of Calif.; Mel Nance, Fuquay-Varina, N.C.

[73] Assignee: Raychem Corporation, Menlo Park, Calif.

[21] Appl. No.: 788,127

[22] Filed: Jan. 23, 1997

[51] Int. Cl.[6] ..... H01R 11/22

[52] U.S. Cl. ..... 439/852; 439/578; 439/654

[58] Field of Search ..... 439/852, 851, 439/578, 842, 843, 750, 654, 675, 858, 862, 861

[56] References Cited

U.S. PATENT DOCUMENTS

| | | | |
|---|---|---|---|
| 3,955,869 | 5/1976 | Licht | 439/842 |
| 5,498,175 | 3/1996 | Yeh et al. | 439/578 |
| 5,667,409 | 9/1997 | Wong et al. | 439/852 |

*Primary Examiner*—Paula Bradley
*Assistant Examiner*—Tho D. Ta
*Attorney, Agent, or Firm*—Herbert G. Burkard

[57] ABSTRACT

An inexpensive coaxial cable connector, and an inexpensive contact which is suitable for use in an such an inexpensive coaxial cable connector, the connector and the contact being capable of passing electrical signals from low frequency power up to and including telecommunications signals in the range of 1 GHz or more. The connector comprises an elongate, hollow, conductive, cylindrical barrel having an inner radius, $R_{BARREL}$, and a first longitudinal axis; and an elongate, conductive contact. The contact has a first end and a second end which define a length therebetween, a second longitudinal axis, and comprises a cylindrical section. The cylindrical section has an outer radius, $R_{CONTACT}$, which is less than $R_{BARREL}$. The cylindrical section comprises a first external end which is coincident with one of the first end and the second end of the contact, a hollow interior, a first longitudinal slot, the slot located near the external end of the cylindrical section, and has a proximal end and a distal end. The contact also comprises a first spring-tab which is located within the first longitudinal slot and formed from a cut-out which forms the first longitudinal slot. The spring-tab has a fixed end and a free end, the fixed end joined at the proximal end of the slot. The first spring-tab extends generally from the proximal end of the slot toward the distal end of the slot and into the hollow interior of the cylindrical section. The connector comprises means for supporting the contact in the barrel so that the cylindrical section of the contact is contained within and spaced apart from the barrel and the second longitudinal axis is substantially coincident with the first longitudinal axis. The supporting means comprises a dielectric material.

26 Claims, 4 Drawing Sheets

COAXIAL CABLE CONNECTOR

RELATED APPLICATIONS

Not Applicable.

BACKGROUND OF THE INVENTION

1. Field of the Invention

This invention relates to coaxial cable connectors.

2. Introduction to the Invention

With the continuing increase in the supply and demand for programming and services provided via cable television and the like, plus the improved quality and additional features available with digital technology, the bandwidth requirements for such cable systems has increased greatly. Whereas, in the past, such systems have operated satisfactorily with signals in the range of up to perhaps 750 MHz, demands imposed on new systems require signals of 1 GHz or more, and plans for future systems will require signals up to 1.8 to 2.2 GHz or even 3 GHz. Moreover, in addition to carrying broadband signals, as new services are offered via coaxial cable, systems providing such new services are often required to carry power to amplifiers, repeaters and other equipment in the cable transmission system, and/or to subscriber equipment to supplement, back-up or substitute for local utility power.

A connector commonly used in coaxial cable systems is known as the F-connector. The F-connector is typically found on cables and devices from the cable tap at the distribution cable to the subscriber equipment. A male F-connector is typically used to terminate a coaxial cable. A female F-connector may be used to join two cables together or to connect a cable to a device. Because F-connectors are used in such large quantities, it has been necessary to develop F-connectors which are easily assembled and inexpensive. As a result, while adequate for use in past systems, such connectors are typically not adequate to carry the broad spectrum of signals and power required in the emerging cable systems.

One reason prior art F-connectors are not suitable for use in new broadband systems is that such F-connectors do not match the characteristic impedance of the coaxial cables to which they connect, thereby degrading the signals carried on the coaxial cables. One such F-connector, disclosed in U.S. Pat. No. 5,096,444 ("the U.S. Pat. No. '444"), exemplifies the problem. The F-connector disclosed in the U.S. Pat. No. '444 comprises seizing contacts (56 and 58) which are similar to other prior art seizing contacts (16, 22) illustrated in the U.S. Pat. No. '444. Seizing contacts such as those depicted in the U.S. Pat. No. '444 are commonly used in prior art F-connectors.

Other variations of connector approaches, not necessarily limited to F-connectors, are disclosed, for example, in U.S. Pat. Nos. 4,734,064 (the U.S. Pat. No. '064) and 5,456,611 (the U.S. Pat. No. '611). The U.S. Pat. No. '064 discloses an electrical socket which comprises cantilever spring tines (18) which terminate in a convex cross section at their free ends. The spring tines expand as they guide an inserted pin during engagement. The U.S. Pat. No. '611 discloses a circular sleeve comprising a plurality of spaced-apart, axially oriented tines (30).

The disclosures of U.S. Pat. Nos. 4,734,064, 5,096,444 and 5,456,611 are incorporated herein by reference for all purposes.

However, while designed to provide physical and electrical contact with a male connector contact inserted therein, such seizing contacts, tines, and the like, and the connector assemblies in which they reside, are not necessarily designed to properly match the characteristic impedance of the coaxial cables. Such arrangements may be deficient in several respects. The radius of the contact mechanism varies along the length of the mechanism, thereby causing the characteristic impedance of the connector to likewise vary along its length. Next, the outer radius of the contact mechanism does not bear a proper relationship with the inner radius of the connector housing. In addition, when a mating pin or wire is inserted into the contact mechanism, the contact mechanism expands to accept the inserted pin or wire, thereby changing the radius of the contact mechanism, and the amount of such change will depend on the diameter of the inserted pin or wire.

Prior art coaxial cable connectors which are suitable for carrying signals at frequencies of 1 GHz or more are very expensive, as they are typically constructed to fine tolerances thereby requiring significant handling, machining and other such expensive operations. Therefore, such connectors are often available primarily for use in the laboratory in conjunction with expensive equipment, but are normally too expensive to be deployed in the field. Because such connectors are constructed to fine tolerances, such connectors can normally be mated only with male connectors comprising wires, pins or other substrates of a specific size (length and/or diameter) and shape, and often such mating substrates likewise must be machined to fine tolerances. Moreover, the depth to which a mating male substrate can penetrate a female connector is a function not only of the length of the male substrate but also other characteristics of the connectors such as the number of threads on the respective connector housings. Since the number of threads on the housings of male connectors produced by different manufacturers may vary, the female connectors must be capable of accommodating such variations.

It is therefore desirable to provide an inexpensive coaxial cable connector which is capable of carrying signals from low frequency power up to and including telecommunications signals in the range of 1 GHz or more. It is further desirable that such connectors be suitable for use with mating connectors comprising wires, pins and other substrates, including clipped wires, and in which such substrates may be of various lengths and/or diameters, and need not be machined to fine tolerances. It is still further desirable that there be such connectors which are suitable for use in joining two cables together and such connectors which are suitable for connecting a cable to a device.

SUMMARY OF THE INVENTION

We have now discovered an inexpensive coaxial cable connector, and an inexpensive contact which is suitable for use in an such an inexpensive coaxial cable connector, the connector and the contact being capable of passing electrical signals from low frequency power up to and including telecommunications signals in the range of 1 GHz or more.

In a first aspect, the invention provides an electrical connector comprising:

a. an elongate, hollow, conductive, cylindrical barrel having an inner radius, $R_{BARREL}$, and a first longitudinal axis;

b. an elongate, conductive contact having a first end and a second end defining a length therebetween, a second longitudinal axis, and comprising a cylindrical section, the cylindrical section having an outer radius, $R_{CONTACT}$, which is less than $R_{BARREL}$, the cylindrical section comprising (1) a first external end which is coincident with one of the first end and the second end of the contact,
(2) a hollow interior,
(3) a first longitudinal slot, the slot
(a) located near the external end of the cylindrical section, and
(b) having a proximal end and a distal end, and
(4) a first spring-tab, the first spring-tab
(a) located within the first longitudinal slot,
(b) formed from a cut-out which forms the first longitudinal slot, and
(c) having a fixed end and a free end, the fixed end joined at the proximal end of the slot, the first spring-tab extending generally from the proximal end of the slot toward the distal end of the slot and into the hollow interior of the cylindrical section; and c. means for supporting the contact in the barrel so that the cylindrical section of the contact is contained within and spaced apart from the barrel and the second longitudinal axis is substantially coincident with the first longitudinal axis.

In a second aspect, the invention provides an electrical connector comprising:

a. an elongate, hollow, conductive, cylindrical barrel having an inner radius, $R_{BARREL}$, and a first longitudinal axis;

b. an elongate, conductive contact having a second longitudinal axis, and comprising a cylindrical section, the cylindrical section having an outer radius, $R_{CONTACT}$, which is less than $R_{BARREL}$, the cylindrical section comprising
(1) a hollow interior, and
(2) at least one resilient contact member which is secured to the cylindrical section and lies within the hollow interior, and which, when a conductive substrate is pushed into the hollow interior, is resiliently deformed to provide electrical connection between the substrate and the cylindrical section; and c. means for supporting the contact in the barrel so that the cylindrical section of the contact is contained within and spaced apart from the barrel and the second longitudinal axis is substantially coincident with the first longitudinal axis, the supporting means comprising a dielectric material.

In a third aspect, the invention provides a coaxial cable connector which is mateable with an electrically conductive substrate, the connector comprising:

a. an elongate, hollow, conductive, cylindrical barrel having an inner radius, $R_{BARREL}$, and a first longitudinal axis;

b. an elongate, conductive contact having a second longitudinal axis, and comprising a cylindrical section, the cylindrical section having an outer radius, $R_{CONTACT}$, which is less than $R_{BARREL}$, the contact mateable with an electrically conductive substrate having a diameter which may be any value within the range of 0.032 inches to 0.051 inches; and c. means for supporting the contact in the barrel so that the cylindrical section of the contact is contained within and spaced apart from the barrel and the second longitudinal axis is substantially coincident with the first longitudinal axis, the supporting means comprising a dielectric material.

In a fourth aspect, the invention provides an electrical connection, the electrical connection comprising a coaxial cable and a coaxial cable connector of the first aspect of the invention.

In a fifth aspect, the invention provides an electrical connection, the electrical connection comprising a coaxial cable and a coaxial cable connector of the second aspect of the invention.

In a sixth aspect, the invention provides an electrical connection, the electrical connection comprising a coaxial cable and a coaxial cable connector of the third aspect of the invention.

The general line expression for the characteristic impedance $Z_0$ of a transmission line is given by:

$$Z_0 = \sqrt{\frac{R + j\omega L}{G + j\omega C}}$$

where R, G, L and C are the series resistance, shunt conductance, series inductance and shunt capacitance per unit length, respectively, of the transmission line. For a lossless transmission line, the characteristic impedance reduces to:

$$Z_0 = \sqrt{\frac{L}{C}}$$

FIG. 1 shows a cross-section of a coaxial transmission line 10 comprising an outer conductor 11 and an inner conductor 12. The outer conductor 11 has an inner surface having a radius $R_O$, and the inner conductor 12 has an outer surface having a radius $R_I$. It is known that the characteristic impedance of a coaxial cable transmission line is given by the equation:

$$Z_0 = \frac{\eta}{2\pi} \ln(R_O/R_I)$$

where $$\eta = \sqrt{\mu/\epsilon}$$

and $\mu$ is the permeability and $\epsilon$ is the permittivity of the dielectric. The characteristic impedance of a coaxial transmission line, comprising an air dielectric, is known to be:

$$Z_0 \cong 60 \ ln \ (R_O/R_I)$$

The most commonly used coaxial cable has a characteristic impedance of 75 ohms. To minimize perturbations of transmitted signals, it is necessary that the characteristic impedance of coaxial cable connectors likewise have a characteristic impedance of 75 ohms. Therefore, a relationship between $R_O$ and $R_I$ for a 75 ohm coaxial cable connector, comprising an air dielectric, can be shown to be:

$$R_O/R_I \cong e^{75/60} \cong 3.49$$

Therefore, a coaxial cable connector of the invention comprises a connector barrel having a first longitudinal axis, and a contact, the contact having first and second ends and comprising a cylindrical section, the cylindrical section having a first external end, and the contact having a second longitudinal axis. Means are provided to support the cylindrical section of the contact within and spaced apart from the barrel, thereby aligning the first and second longitudinal axes, i.e. forming a concentric arrangement.

To be consistent with the above equation, in the discussion which follows, the inner surface of the barrel has a radius which will be referred to as $R_{BARREL}$, and the outer surface of the cylindrical section of the contact has a radius which will be referred to as $R_{CONTACT}$. $R_{BARREL}$ and $R_{CON-}$ $_{TACT}$ substantially conform to the above relationship. When mated with a male connector comprising a wire, pin or other substrate, the cylindrical section of the contact of the invention mates with the inserted substrate while continuing to maintain a constant outer radius of $R_{CONTACT}$.

The cylindrical section of the contact comprises an elongated longitudinal slot which is located near the first external end of the cylindrical section. The first external end of the cylindrical section is coincident with one of the first end and the second end of the contact. The slot has a proximal end and a distal end. Within the slot is located a spring-tab, the spring-tab formed from a cut-out which forms the slot. In a preferred embodiment of the invention, the spring-tab is v-shaped, comprising first and second legs, the legs meeting at a vertex. The first leg of the v-shaped spring-tab has a fixed end. The fixed end is joined to the proximal end of the longitudinal slot and forms an angle with the proximal end of the slot thereby extending the spring-tab toward the distal end of the slot and into the hollow interior of the cylindrical section. The second leg of the contact is normally substantially shorter than the first leg. The purpose of the second leg is to facilitate insertion and removal of a substrate within the contact without scraping or jamming on the surface of the inserted substrate. In other embodiments, rather than having a second leg, the spring-tab may take on other shapes to accomplish this purpose, e.g. a single leg having a smoothed or rounded end.

In one embodiment of a coaxial cable connector of the invention, the proximal end of the slot is located adjacent to one end of the contact, and the spring-tab extends into the slot away from the end of the contact. In another embodiment, the distal end of the slot is located adjacent to one end of the contact, and the spring-tab extends into the slot toward the end of the contact. The direction the spring-tab extends, from its fixed end to its free end, with respect to the end of the contact and the interior of the cylindrical section of the contact, is referred to herein as the "pointing direction."

In certain embodiments of coaxial cable connectors of the invention, two or more slots, each slot comprising a spring-tab, may be located adjacent to the same end of the contact, with the slots spaced around the circumference of the cylindrical section of the contact. The slots may all be equidistant from the end of the contact, or may be staggered at varying distances. In addition, the spring-tabs located in the slots may all be fixed to have the same pointing direction, or may be fixed with one or more spring-tabs having one pointing direction, and one or more spring-tabs having the opposite pointing direction.

When a wire, pin or other conducting substrate is inserted into the contact, the spring-tab receives the substrate, typically making initial contact at or near the vertex of the spring tab, often referred to as a connection point, and the spring-tab is deflected outward, toward the slot opening. However, the spring-tab does not protrude outside the outer radius of the cylindrical section. The spring-tab thereby makes a physical and electrical connection with the inserted substrate. The spring-tab is held in compression and maintains a spring force against the inserted substrate, however, such force is not sufficient to hold the substrate within the contact. If the substrate is removed from within the contact, the spring-tab returns to its original position.

The lengths of the first and second legs of the spring-tab, the angles formed at the fixed end of the spring-tab and at the vertex, the distance from the end of the contact to the slot opening and the pointing direction of the spring-tab may each be chosen to obtain preferred performance for the requirements of a particular application. As the length of the spring-tab increases, the spring force applied to an inserted substrate decreases; and, conversely, as the length of the spring-tab decreases, the applied spring force increases. However, as the length of the spring-tab decreases, the increased spring force can cause the spring-tab to permanently deform when a substrate is inserted into the contact, and, in such case, when the substrate is removed from the contact, the spring-tab would fail to return to its original position. Moreover, as the length of the spring-tab increases, the maximum diameter of a substrate which the contact can accept decreases; and, conversely, as the length of the spring-tab decreases, the minimum diameter of a substrate which the contact can accept must increase. The ability of the spring-tab to accommodate substrates of varying diameters is often referred to as "range-taking."

For example, in a preferred embodiment of a coaxial cable connector of the invention, suitable for receiving wires, pins and other substrates ranging from 0.032 inches (corresponding to RG59 cable) to 0.051 inches (corresponding to RG7 cable) in diameter (including 0.040 inches (corresponding to RG6 cable)):

a. the contact is comprised of material about 0.01 inches thick, with the cylindrical section having an outer diameter of about 0.075 inches and an inner diameter of about 0.055 inches;

b. the proximal end of the slot and fixed end of the spring-tab are located about 0.04 inches from the end of the contact;

c. extending from the proximal end of the slot, the first leg of the spring-tab forms an angle of about −18 degrees with the longitudinal axis of the contact;

d. the first leg is about 0.110 inches in length;

c. at the underside of the vertex, the clearance between the spring tab and the inner wall of the contact, opposite the slot opening, is about 0.021 inches;

f. extending from the vertex, the second leg forms an angle of about +13 degrees with the longitudinal axis of the contact; and g. the second leg is about 0.04 inches in length.

In another preferred embodiment, the contact is comprised of material about 0.008 inches thick. In some applications, this slightly thinner material may allow for greater deflection of the spring-tab within the elastic range of the material.

In addition to accepting wires, pins and other substrates of different diameters, coaxial cable connectors of the invention are capable of accepting wires, pins and other substrates of different lengths. In particular, in order to accommodate very short substrates, the fixed end of the spring-tab is located very close to the end of the cylindrical contact.

The slot and the spring-tab are small compared with the overall surface of the contact. In use, with a wire, pin or other substrate inserted into the contact, the spring-tab's surface is substantially congruent with the outer surface of the contact. Therefore, the slot and the spring-tab have a negligible effect on the overall impedance of the coaxial cable connector.

Coaxial cable connectors of the invention may be used to join a coaxial cable to a box, chassis, tap or other such housing, or to join two coaxial cables together. In the case of the former, the connector may be "single ended", i.e. the contact comprises a cylindrical section and a flattened section, with a transition interface between the two sections. A spring-tab is located near the first external end of the cylindrical section of the contact, with the opposite ends of the contact and the connector barrel adapted to mount to a housing, printed circuit board, and the like. In the case of the latter, the connector may be "dual-ended", i.e. the contact comprises only a cylindrical section and no flattened section. The cylindrical section comprises a first external end coinciding with one of the first end and second end of the contact, a second external end coinciding with the other of the first end and second end of the contact, and two slots with corresponding spring-tabs. A first spring-tab is located near the first end of the contact, and a second spring-tab located near the second end of the contact.

In both single-ended and dual-ended embodiments of a coaxial cable connector of the invention, the contact may comprise two or more spring-tabs located near the or each end of the contact, as the case may be. In order to insure making contact with inserted substrates having a range of diameters, a single spring-tab must extend further into the hollow interior than would each of two spring-tabs. In some instances, a single spring-tab, after having mated with a larger diameter substrate, may not fully return to its original position and thus might not subsequently mate properly with a smaller diameter substrate. However, in a contact having two spring-tabs, each spring-tab would experience less travel when mated with a larger diameter substrate, and thus would be more likely to return to its respective original position upon removal of the wider diameter substrate. Hence, upon subsequent insertion of a smaller diameter substrate, the two spring-tabs would be properly positioned to mate with the smaller diameter spring-tab.

In a preferred embodiment of a coaxial cable connector of the invention, the contact is comprised of a high-performance alloy having a yield strength of at least about $150\times10^3$ lb/in$^2$ and a modulus of elasticity of at least about $19\times10^6$ lb/in$^2$. Some examples of suitable alloys include Beryllium Copper C17200 (comprising about 1.8 wt % Be, about 0.2 wt % Co and about 98 wt % Cu) sold as Brush Alloy 25 by Brush Wellman Inc, and Beryllium Nickel N03369 (comprising about 2.0 wt % Be, 0.5 wt % Ti, and about 97.5 wt % Ni) also sold by Brush Wellman. The alloys are typically tempered to ¼ hardness and heat treated. These materials are selected to provide the tensile strength in the range necessary for a spring-tab capable of returning to a relaxed position after a number of re-entries by mating male substrates. For example, the modulus of elasticity and yield strength of the Beryllium Copper and Beryllium Nickel alloys are shown in Table 1. Other copper alloys such as Spinodal C72650, C72700, and C72900 sold by Ametek Inc. may also be used depending on the requirements of the particular application.

TABLE 1

| | UNS | | Modulus of Elasticity | | Yield Strength | |
|---|---|---|---|---|---|---|
| Alloy | Designation | Composition | lb/in$^2$ | kg/mm$^2$ | $10^3$ lb/in$^2$ | kg/mm$^2$ |
| Beryllium Copper | C17200 | ~1.8 wt % Be<br>~0.2 wt % Co<br>~98.0 wt % Cu | $19 \times 10^6$ | $13.5 \times 10^3$ | 150 to 185 | 105 to 130 |
| Beryllium Nickel | N03360 | ~2.0 wt % Be<br>~0.5 wt % Ti<br>~97.5 wt % Ni | $28 \times 10^6$ to $30 \times 10^6$ | $19.7 \times 10^3$ to $21.0 \times 10^3$ | 175 min. | 123 min. |

The contact may be formed from a flat sheet which may be first stamped to a desired shape and then rolled to form a cylinder, a seam formed from the parallel opposite edges being butted together in the rolling process. For single ended-contacts, after the rolling step, one end of the cylinder may then flattened and stamped to the desired shape for a solder or other connection.

The contact may also be formed by extrusion in a cylindrical shape. Although more expensive, this would eliminate the seam formed in the rolling process, and thereby facilitate having multiple slots and spring tabs positioned around the circumference of the cylindrical section.

Thin dielectric rings support the contact within the barrel. The rings are typically placed at the two ends of the barrel and are retained in place by detents, flanges or the like in the barrel, in cooperation with the ends of the contact. Since the dimensions $R_{BARREL}$ and $R_{CONTACT}$ are based on the coaxial cable connector comprising an air dielectric, it is desirable to minimize the thickness of the dielectric rings, while providing sufficient strength to hold the contact in place. In a preferred embodiment, the dielectric rings are comprised of acrylonitrile-butadiene-styrene (ABS) which is available from the Monsanto Chemical Company.

In preferred embodiments of coaxial cable connectors of the invention, the cylindrical barrel has a first end, the first end having a radially inwardly directed annular flange which defines a central aperture or port. The flange is sized to retain a dielectric ring within the hollow interior of the barrel. The cylindrical barrel has a second, open end, through which internal components are inserted into the barrel. After the internal components are inserted into the barrel, the second end may be closed by known means, e.g., by rolling or "swaging" the edge of the barrel thereby bending an annular lip to retain the components within the housing, or by inserting a retainer cap as disclosed in the U.S. Pat. No. '444. The latter method having the advantage of providing a flat end to mate with a male connector.

BRIEF DESCRIPTION OF THE DRAWINGS

For a better understanding of the nature and objects of the invention, reference should be had to the following detailed description of the preferred embodiments of the invention, taken in conjunction with the accompanying drawings, in which like components are given the same reference numerals in each FIG. in which they appear, and in which.

Note that FIGS. 2–9 are not drawn to scale.

DETAILED DESCRIPTION OF THE INVENTION

Figure 1:
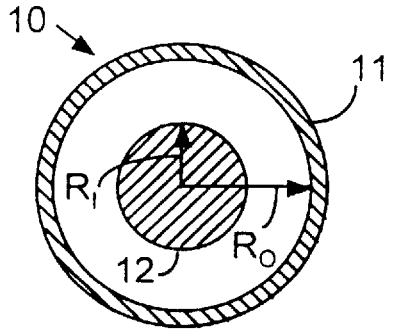
FIG. 1 shows a cross section of a coaxial transmission line.
Figure 2:
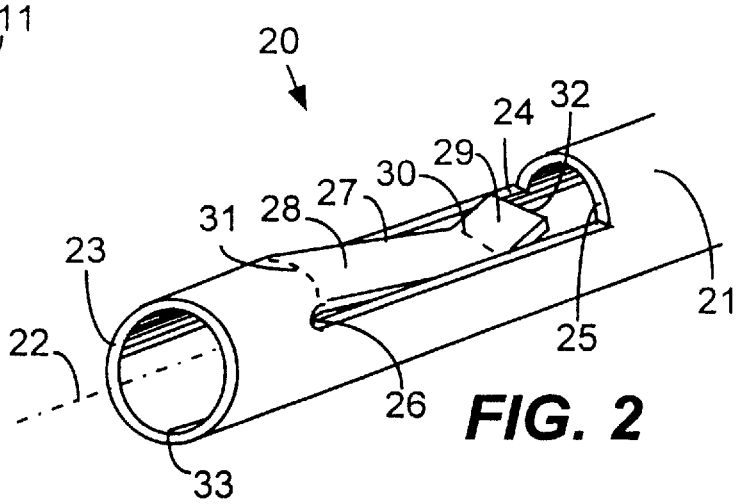
FIG. 2 is a perspective view of an embodiment of a cylindrical section of a contact of the invention.

FIG. 2 Is a perspective view of an embodiment of a cylindrical section 20 of a contact of the invention. The cylindrical section 20 is comprised of an elongate cylinder 21 and has a longitudinal axis 22 and a first external end 23. A longitudinal slot 24 is formed in the cylinder 21, the slot 24 having a proximal end 26 and a distal end 25. As depicted in FIG. 2, the proximal end 26 is located near the first external end 23 of the cylindrical section 20. However, in other embodiments (e.g., see FIG. 6 and discussion below), the ends of the slot 24 may be reversed, i.e., with the distal end 25 of the slot 24 located near the first external end 23. The cylindrical section 20 may have a longitudinal seam 33.

Located in the slot 24, and formed from a cutout which forms the slot 24, is a spring-tab 27. The spring-tab 27 has a fixed end 31 and a free end 32. The spring-tab 27 is joined to the elongate cylinder 21 at the proximal end 26 of the slot 24. As depicted in the embodiment shown in FIG. 2, the spring-tab 27 is v-shaped, comprising first and second legs 28 29 joined at a vertex 30. The first leg 28 is typically substantially longer than the second leg 29. The underside of the vertex 30 may be smoothed or rounded to facilitate the insertion and removal of male coaxial connector substrates.

Figure 3:
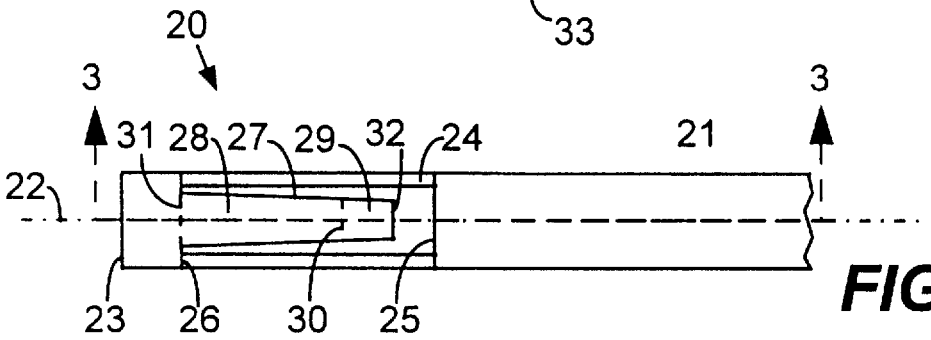
FIG. 3 is a plan view of an embodiment of a cylindrical section of a contact of the invention.

FIG. 3 is a plan view of a cylindrical section 20 of a contact of the invention. The elements of the cylindrical section 20 depicted in FIG. 3 are the same as those indicated with the corresponding respective reference numerals in FIG. 2. As depicted in FIG. 3, the first spring-tab 27 tapers slightly from the fixed end 31 toward the free end 32. In other embodiments, the first spring-tab 27 may have other shapes, e.g. rectangular, tongue-shaped (curved ends), etc.

Figure 4:
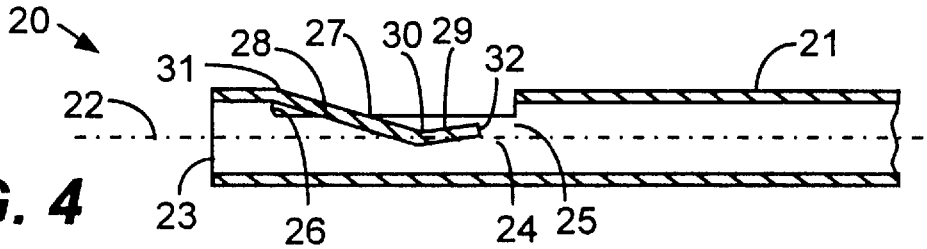
FIG. 4 is a cross-sectional view of an embodiment of a cylindrical section of a contact of the invention taken along the plane 3—3 in FIG. 3.

FIG. 4 is a cross-sectional view of a cylindrical section 20 of a contact of the invention, taken at the plane 3—3 of FIG. 3. The elements of the cylindrical section 20 depicted in FIG. 4 are the same as those indicated with the corresponding respective reference numerals in FIGS. 2 and 3.

Figure 5:
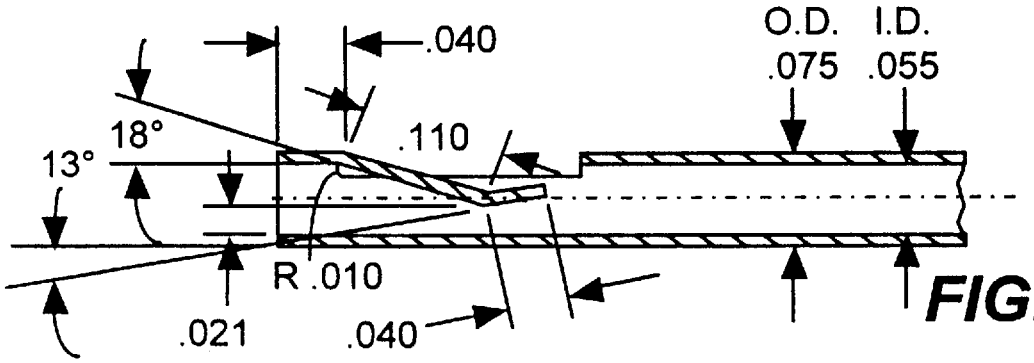
FIG. 5 is the view shown in FIG. 4 with representative dimensions for one example of an embodiment of a cylindrical section of a contact of the invention.

FIG. 5 is the same cross-sectional view as shown in FIG. 4, with the reference numerals removed and certain dimensions indicated. The dimensions indicated correspond to an example of an embodiment of a cylindrical section 20 of a contact of the invention which is mateable with wires, pins and other substrates ranging from 0.032 inches (corresponding to RG59 cable) to 0.051 inches (corresponding to RG7 cable) in diameter.

Figure 6:
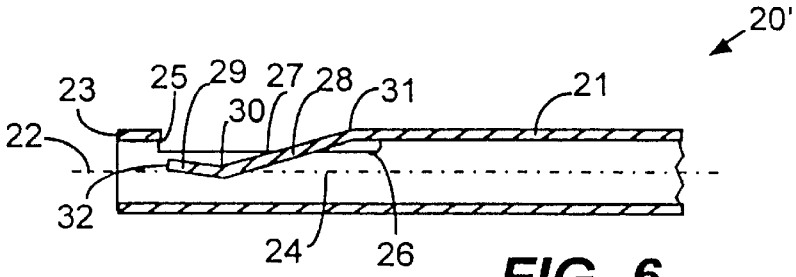
FIG. 6 is a cross-sectional view of an embodiment of a cylindrical section of a contact of the invention wherein the distal end of the slot is located near the external end of the cylindrical section.

FIG. 6 is a cross-sectional view of an embodiment of a cylindrical section 20' of a contact of the invention wherein the distal end 25 of the slot 24 is located near the first external end 23 of the cylindrical section 20'. The elements of the cylindrical section 20' depicted in FIG. 6 are the same as those indicated with the corresponding respective reference numerals in FIGS. 2, 3 and 4. As depicted in FIG. 6, the pointing direction of the spring-tab 27 is toward, rather than away from, the first external end 23.

Figure 7:
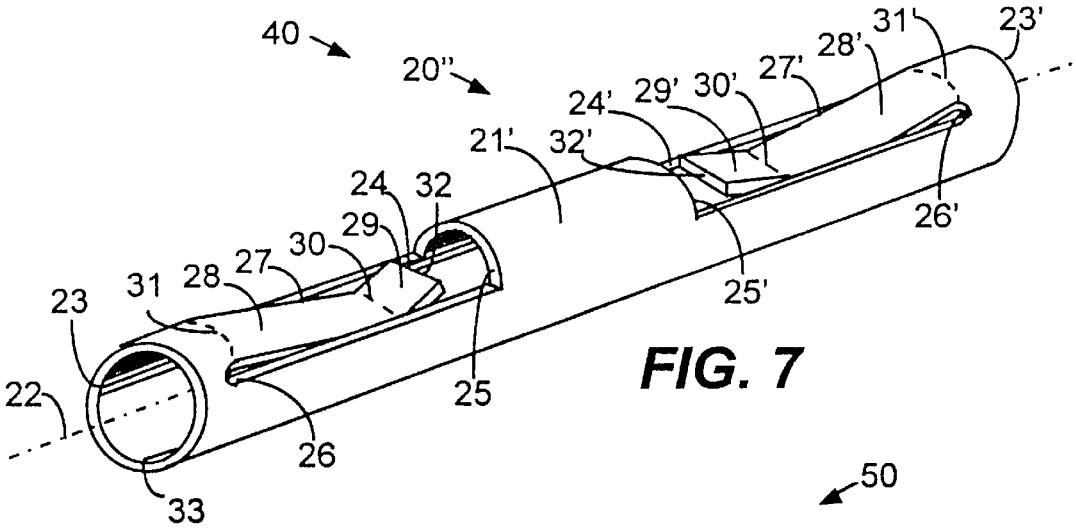
FIG. 7 is a perspective view of an embodiment of dual-ended contact of the invention.

FIG. 7 is a perspective view of a dual-ended contact 40 of the invention which comprises a cylindrical section 20". The cylindrical section 20" is comprised of an elongate cylinder 21' having first and second external ends 23 23', a second elongate slot 24' and a second spring-tab 27'. The elements of the dual-ended contact 40 depicted in FIG. 7 having primed reference numerals correspond with the elements depicted in FIGS. 2, 3 and 4 having the corresponding respective unprimed reference numerals.

Figure 8:
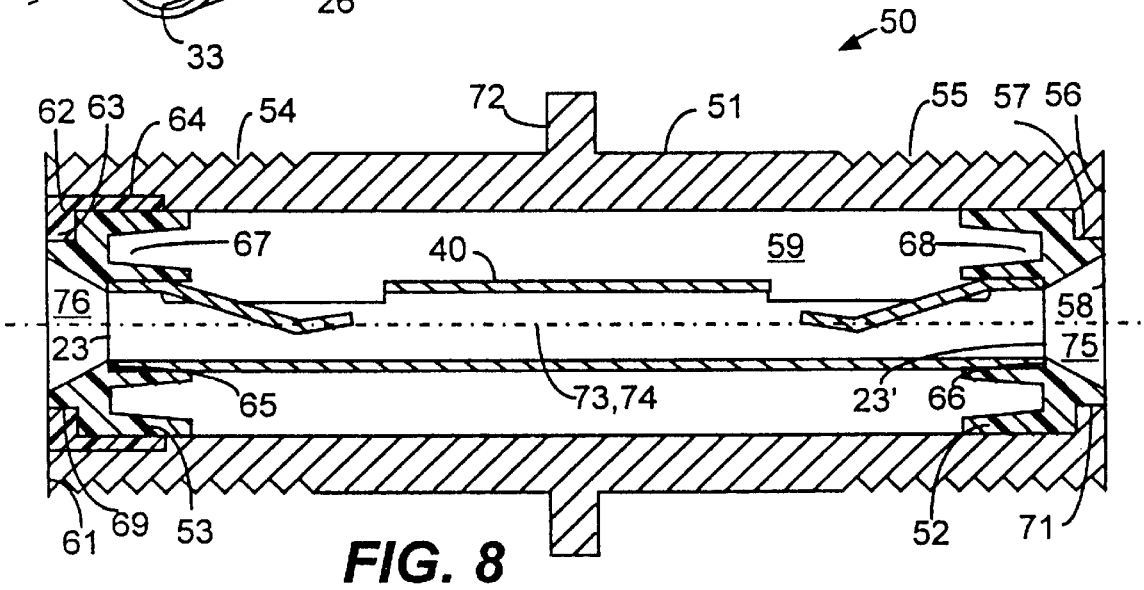
FIG. 8 is a cross-sectional view of an embodiment of a dual-ended coaxial cable connector of the invention.

FIG. 8 is a cross-sectional view of an embodiment of a dual-ended coaxial cable connector 50 of the invention. In the embodiment depicted in FIG. 8, the dual-ended connector 50 comprises a cylindrical barrel 51, a dual-ended contact 40 similar to that shown in FIG. 7, dielectric rings 52 53, and a retainer cap 62. The elements of the dual ended contact 40 have been previously discussed, and will generally not be discussed with reference to FIG. 8.

The cylindrical barrel 51 is similar to connector barrels which are common in the industry. The barrel is threaded 54 55 at two ends to mate with corresponding threaded shells from male connectors. The cylindrical barrel 51 has a first end 56, the first end 56 having a radially inwardly directed annular flange 57 which defines a central aperture 58. The flange 57 is sized to retain a dielectric ring 52 within the hollow interior 59 of the barrel 51. The cylindrical barrel 51 has a second, open end 61, through which internal components are inserted into the barrel 51. After the internal components are inserted into the barrel 51, the second end 61 is closed by inserting a retainer cap 62 similar to that disclosed in the U.S. Pat. No. '444. The retainer cap 62 comprises a radially inwardly directed annular lip 63 which retains a dielectric ring 53 within the hollow interior 59 of the barrel 51. The diameter of the retainer cap 62 is substantially the same as the inner diameter of an internal shoulder 64 of the barrel 51. The retainer cap 62 is held in place by means of a press fit with the shoulder 64. Alternatively, and not illustrated in any of the FIGs., the open end 61 may be rolled or swaged to form a radially inwardly directed annular lip to retain the components within the barrel 51. This is a common practice known and used in the industry.

The dielectric rings 52 53 are held in place against the retainer cap 62 and annular flange 57, respectively, by the dual-ended contact 40, the first and second external ends 23 23' of which are held against an annular lip 65 66 in the respective dielectric rings 52 53. As depicted in FIG. 8, the dielectric rings 52 53, comprise annular depressions 67 68. Since $R_{BARREL}$ and $R_{CONTACT}$ are based on having an air dielectric within the interior 59 of the connector barrel 51, the annular depressions 67 68 serve to minimize the volume of the dielectric rings 52 53 within the barrel interior 59. Other configurations of dielectric rings 52 53 may be used, e.g., thinner-flatter rings, rings having spokes, etc. The dielectric rings 52 53 each have an annular indent 69 71 which mates with the corresponding respective annular lip 62 and annular flange 57. The dielectric rings 52 53 each have a converging aperture 75 76 to help guide male substrates into the respective ends 23 23' of the contact 40.

The cylindrical barrel 51 comprises an exterior hexagonal extension 72 which is commonly provided to facilitate holding the connector 50 with a wrench or other tool during installation and/or removal of the connector 50.

A single longitudinal axis is shown with reference numerals 73 74 to indicate that the first longitudinal axis 73 of the barrel 51 and the second longitudinal axis 74 of the contact 40 are substantially aligned.

Figure 9:
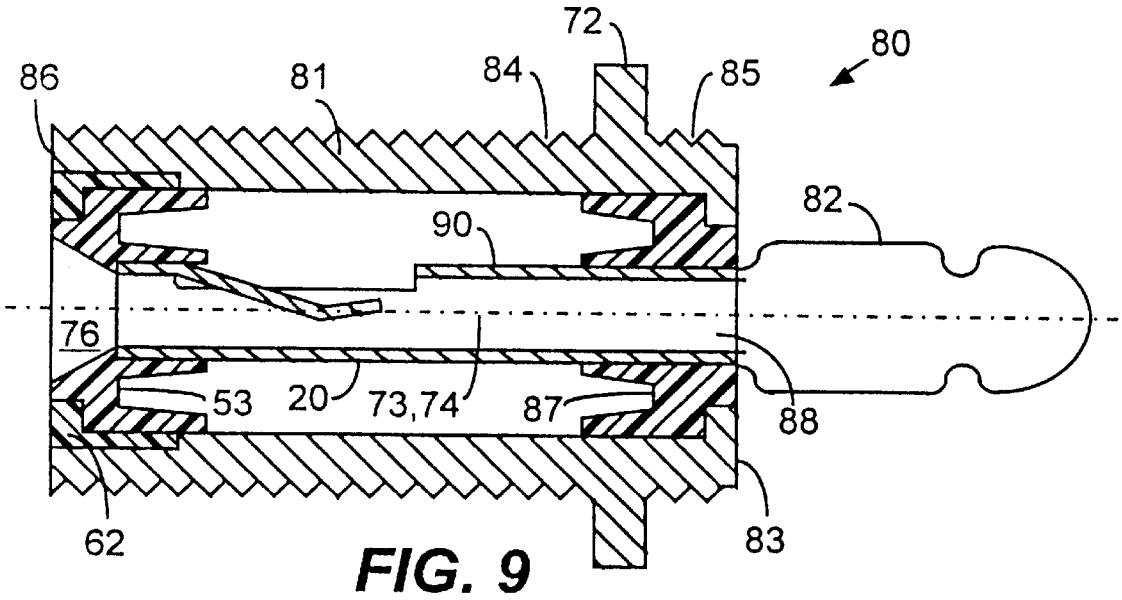
FIG. 9 is a cross-sectional view of an embodiment of a single-ended coaxial cable connector of the invention.

FIG. 9 is a cross-sectional view of an embodiment of a single-ended coaxial cable connector 80 of the invention. In the embodiment depicted in FIG. 9, the single-ended connector 80 comprises a cylindrical barrel 81, a single-ended contact 90, dielectric rings 53 87, and a retainer cap 62. The single-ended contact 90 has a cylindrical section 20 and a flattened section 82. The elements of the cylindrical section 20 have been previously discussed, and will generally not be discussed with reference to FIG. 9. The dielectric rings 53 87 and retainer cap 62 are generally the same or similar to those previously discussed, however the dielectric ring 87 located nearest the closed end 83 of the barrel 81 forms a cylindrical aperture 88 rather than the converging aperture 76 formed by the dielectric ring 53 nearest the open end 86 of the barrel 81. The flattened section 82 is depicted in FIG. 9 as having a generally elongate spade-like shape. The flattened section 82 may be shaped as required for the application, e.g. mounting to a printed circuit board.

The cylindrical barrel 81 comprises an exterior hexagonal extension 72 similar to that discussed above. As depicted in FIG. 9, the cylindrical barrel 81 comprises threaded sections 84 85 on either side of the hexagonal extension 72. The threaded sections 84 85 typically facilitate mounting the connector 80 to a box, chassis, or other device, as well as to a threaded shell from a mating male connector.

Figure 10:
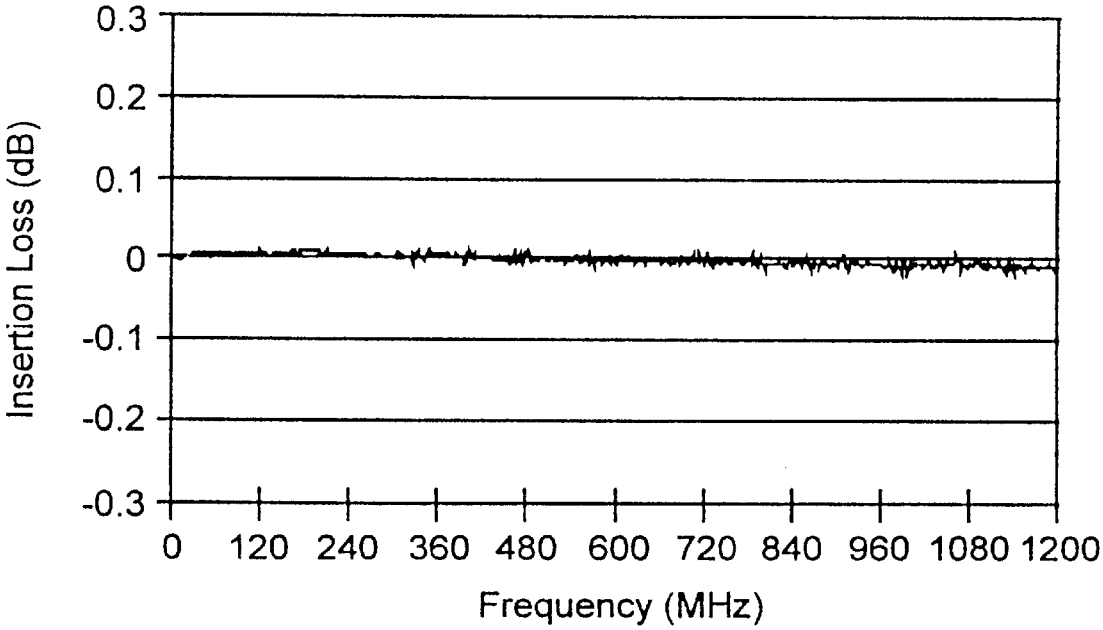
FIG. 10 is a plot of insertion loss versus frequency for a sample coaxial cable connector of the invention.
Figure 11:
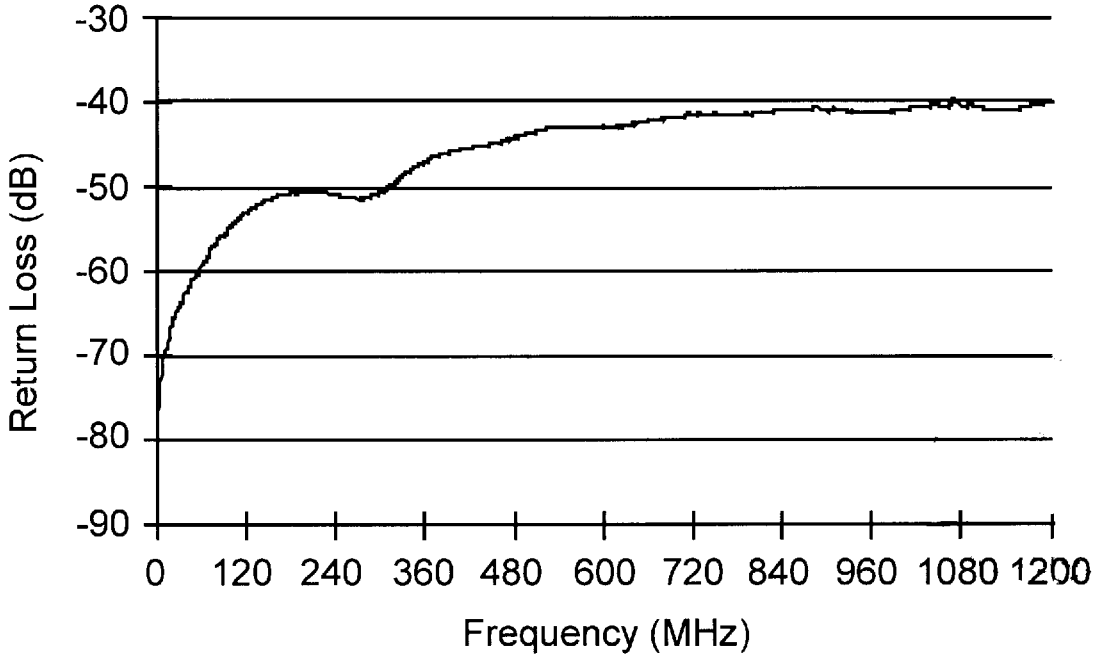
FIG. 11 is a plot of return loss versus frequency for a sample coaxial cable connector of the invention.

FIG. 10 shows a plot of insertion loss versus frequency for a sample coaxial cable connector of the invention. The plot shows a nearly flat response up to and past 1 GHz. The plot shows the insertion loss to be less than about 0.02 dB at 1 GHz. FIG. 11 shows a plot of return loss versus frequency for a sample coaxial cable connector of the invention. The plot shows the return loss to be greater than about 40 dB at 1 GHz. Both the insertion loss and return loss measurements are characteristic of the performance that would normally be expected only from much more expensive coaxial cable connectors.

In preferred embodiments disclosed herein, a coaxial cable connector of the invention comprises a cylindrical barrel and a contact having a cylindrical section. The contact comprises a slot and a spring-tab which are both located within the cylindrical section, and oriented so that the spring-tab mates with an inserted wire, pin or other substrate. The spring-tab mates with such substrates without protruding outside the radius of the outer surface of the cylindrical section of the contact. It is to be understood that cylindrical sections of contacts of coaxial cable connectors of the invention may comprise other structures capable of mating with an inserted wire, pin or other substrate, including such substrates having diameters anywhere in the range from 0.032 inches to 0.051 inches, and doing so without protruding outside the radius of the outer surface of the cylindrical section of the contact.

The foregoing detailed description of the invention includes passages which are chiefly or exclusively concerned with particular parts or aspects of the invention. It is to be understood that this is for clarity and convenience, that a particular feature may be relevant in more than just the passage in which it is disclosed, at that the disclosure herein includes all the appropriate combinations of information found in the different passages. Similarly, although the various figures and descriptions herein relate to specific embodiments of the invention, it is to be understood that where a specific feature is disclosed in the context of a particular figure, such feature can also be used, to the extent appropriate, in the context of another figure, in combination with another feature, or in the invention in general.

Further, while the present invention has been particularly described in terms of certain preferred embodiments, the invention is not limited to such preferred embodiments. Rather, the scope of the invention is defined by the appended claims.

We claim:

1. An electrical connector comprising:

a. an elongate, hollow, conductive, cylindrical barrel having an inner radius, ($R_{BARREL}$), and a first longitudinal axis;

b. an elongate, conductive contact having a first end and a second end defining a length therebetween, a second longitudinal axis, and comprising a cylindrical section, the cylindrical section having an outer radius, ($R_{CONTACT}$), which is less than ($R_{BARREL}$), the cylindrical section comprising (1) a first external end which is coincident with one of the first end and the second end of the contact, (2) a hollow interior, (3) a first longitudinal slot, the slot (a) located near the external end of the cylindrical section, and (b) having a proximal end and a distal end, and (4) a first spring-tab, the first spring-tab (a) located within the first longitudinal slot opposite adjacent interior portions of the cylindrical section of the contact, (b) formed from a cut-out which forms the first longitudinal slot, and (c) having a fixed end and a free end, the fixed end joined at the proximal end of the slot, the first spring-tab extending generally from the proximal end of the slot toward the distal end of the slot and into the hollow interior of the cylindrical section to bias an inner conductor of a coaxial transmission line against the opposing adjacent interior portions of the cylindrical section of the contact; and c. means for supporting the contact in the barrel so that the cylindrical section of the contact is contained within and spaced apart from the barrel and the second longitudinal axis is substantially coincident with the first longitudinal axis.

2. A connector according to claim 1, wherein a ratio of the inner radius ($R_{BARREL}$) to the outer radius ($R_{CONTACT}$) is about equal to 3.49.

3. A connector according to claim 1, wherein the first spring-tab is v-shaped, comprising a first leg and a second leg, the two legs joined at a vertex, with the first leg extending from the fixed end of the spring-tab to the vertex, and the second leg extending from the vertex to the free end of the spring-tab.

4. A connector according to claim 3, wherein the first leg of the spring-tab is substantially longer than the second leg.

5. A connector according to claim 1, wherein the first external end of the cylindrical section is at the first end of the contact.

6. A connector according to claim 5, wherein the proximal end of the slot is located adjacent to the first external end of the cylindrical section.

7. A connector according to claim 5, wherein the distal end of the slot is located adjacent to the first external end of the cylindrical section.

8. A connector according to claim 1, wherein the cylindrical section comprises:

a. a second longitudinal slot, the slot having a proximal end and a distal end; and b. a second spring-tab, the second spring-tab (1) located within the second longitudinal slot opposite adjacent interior portions of the cylindrical section of the contact, (2) formed from a cut-out which forms the second longitudinal slot, and (3) having a fixed end and a free end, the fixed end joined at the proximal end of the second longitudinal slot, the second spring-tab extending generally from the proximal end of the second longitudinal slot toward the distal end of the second longitudinal slot and into the hollow interior of the cylindrical section to bias an inner conductor of a coaxial transmission line against the opposing adjacent interior portions of the cylindrical section of the contact.

9. A connector according to claim 8, wherein the cylindrical section extends the length of the contact and comprises a second external end, the second external end being coincident with the other of the first end and the second end of the contact.

10. A connector according to claim 9, wherein the first longitudinal slot is located adjacent to one of the first end or second end of the contact, and the second longitudinal slot is located adjacent to the other of the first end or the second end of the contact.

11. A connector according to claim 9, wherein the proximal end of the first longitudinal slot is located adjacent to the first end of the contact, and the proximal end of the second longitudinal slot is located adjacent to the second end of the contact.

12. A connector according to claim 1, wherein the contact is comprised of metal having a yield strength of at least $150\times10^3$ lb/in$^2$ and a modulus of elasticity of at least $19\times10^6$ lb/in$^2$.

13. A connector according to claim 12, wherein the contact is comprised of metal selected from the group consisting of:

a. about 1.8 wt % beryllium, about 0.2 wt % cobalt, and about 98 wt % copper; and b. about 2.0 wt % beryllium, about 0.5% titanium, and about 97.5 wt % nickel.

14. A connector according to claim 1, wherein the means for supporting the contact in the barrel comprises a ring comprised of a dielectric material.

15. A connector according to claim 14 wherein the ring is comprised of acrylonitrile-butadiene-styrene.

16. A connector according to claim 1 which has an insertion loss of not more than 0.1 dB at 1 GHz.

17. A connector according to claim 16 which has an insertion loss of not more than 0.02 dB at 1 GHz.

18. A connector according to claim 1 which has a return loss of not less than 30 dB at 1 GHz.

19. A connector according to claim 18 which has a return loss of not less than 40 dB at 1 GHz.

20. A connector according to claim 1 which, in use, carries an electrical signal at a frequency of at least 1 GHz.

21. A connector according to claim 20 which, in use, carries electrical power.

22. An electrical connector comprising:

a. an elongate, hollow, conductive, cylindrical barrel having an inner radius, ($R_{BARREL}$), and a first longitudinal axis;

b. an elongate, conductive contact having a second longitudinal axis, and comprising a cylindrical section, the cylindrical section having an outer radius ($R_{CONTACT}$), which is less than ($R_{BARREL}$), the cylindrical section comprising (1) a hollow interior, and (2) at least one spring-tab secured to the cylindrical section and lying within the hollow interior opposite adjacent interior portions of the cylindrical section of the contact, and which, when a conductive substrate is pushed into the hollow interior, is resiliently deformed to provide electrical connection between the substrate and the cylindrical section by biasing the substrate against the opposing adjacent interior portions of the cylindrical section of the contact; and c. means for supporting the contact in the barrel so that the cylindrical section of the contact is contained within the spaced apart from the barrel and the second longitudinal axis is substantially coincident with the first longitudinal axis, the supporting means comprising a dielectric material.

23. A connector according to claim 22, wherein a ratio of the inner radius ($R_{BARREL}$) to the outer radius ($R_{CONTACT}$) is about equal to 3.49.

24. A connector according to claim 22, which has an insertion loss of not more than 0.1 dB at 1 GHz and a return loss of not less than 30 dB at 1 GHz.

25. A coaxial cable connector which is mateable with an electrically conductive substrate, the connector comprising:

a. an elongate, hollow, conductive, cylindrical barrel having an inner radius, ($R_{BARREL}$), and a first longitudinal axis;

b. an elongate, conductive contact having a second longitudinal axis, and comprising a cylindrical section and a spring-tab opposite adjacent interior portions of the cylindrical section of the contact for biasing the electrically conductive substrate against the opposing adjacent interior portions of the cylindrical section of the contact, the cylindrical section having an outer radius ($R_{CONTACT}$), which is less than ($R_{BARREL}$), the contact mateable with the electrically conductive substrate having a diameter which may be any value within the range of 0.032 inches to 0.051 inches; and c. means for supporting the contact in the barrel so that the cylindrical section of the contact is contained within and spaced apart from the barrel and the second longitudinal axis is substantially coincident with the first longitudinal axis, the supporting means comprising a dielectric material.

26. An electrical connection comprising a coaxial cable and a coaxial cable connector, the connector comprising:

a. an elongate, hollow, conductive, cylindrical barrel having an inner radius, ($R_{BARREL}$), and a first longitudinal axis;

b. an elongate, conductive contact, a second longitudinal axis, and comprising a cylindrical section, the cylindrical section having an outer radius, ($R_{CONTACT}$), which is less than ($R_{BARREL}$), the cylindrical section comprising (1) a first external end, (2) a hollow interior, (3) a first longitudinal slot, the slot (a) located near the first external end of the cylindrical section, and (4) a first spring-tab, the first spring-tab (a) located within the first longitudinal slot opposite adjacent interior portions of the cylindrical section of the contact, (b) formed from a cut-out which forms the first longitudinal slot, and (c) having a fixed end and a free end, the first spring-tab extending generally into the hollow interior of the cylindrical section to bias an inner conductor of the coaxial cable against the opposing adjacent interior portions of the cylindrical section of the contact; and c. means for supporting the contact in the barrel so that the cylindrical section of the contact is contained within and spaced apart from the barrel and the second longitudinal axis is substantially coincident with the first longitudinal axis, the supporting means comprising a dielectric material.

* * * * *